US009642469B2

(12) United States Patent
Savicki et al.

(10) Patent No.: US 9,642,469 B2
(45) Date of Patent: May 9, 2017

(54) SEATING APPARATUS WITH ADJUSTABLE CUSHIONING

(71) Applicants: Paul Savicki, Hickory, NC (US); Gary Fox, Hickory, NC (US)

(72) Inventors: Paul Savicki, Hickory, NC (US); Gary Fox, Hickory, NC (US)

( * ) Notice: Subject to any disclaimer, the term of this patent is extended or adjusted under 35 U.S.C. 154(b) by 0 days.

(21) Appl. No.: 14/588,326

(22) Filed: Dec. 31, 2014

(65) Prior Publication Data

US 2016/0183690 A1 Jun. 30, 2016

(51) Int. Cl.

| | |
|---|---|
| ***A47C 7/14*** | (2006.01) |
| ***A47C 7/18*** | (2006.01) |
| ***A47C 4/54*** | (2006.01) |
| ***A47C 27/08*** | (2006.01) |
| ***A47C 7/02*** | (2006.01) |

(52) U.S. Cl.

CPC ..... *A47C 27/081* (2013.01); *A47C 4/54* (2013.01); *A47C 7/021* (2013.01); *A47C 27/082* (2013.01); *A47C 27/088* (2013.01)

(58) Field of Classification Search

CPC ..... A47C 4/54; A47C 7/021; A47C 27/081; A47C 27/082; A47C 27/088

USPC ..... 297/284.6, 452.41

See application file for complete search history.

(56) References Cited

U.S. PATENT DOCUMENTS 3,574,873 A * 4/1971 Weinstein ..... A47C 27/085 297/452.41
4,491,157 A * 1/1985 Hashimoto ..... A47C 4/54 297/284.6 X
4,592,588 A * 6/1986 Isono ..... A47C 7/022 297/284.6 X
4,655,505 A * 4/1987 Kashiwamura ..... A47C 7/467 297/284.6
4,960,304 A * 10/1990 Frantz ..... A47C 7/021 297/284.6
5,082,326 A * 1/1992 Sekido ..... B60N 2/4415 297/284.6
5,135,282 A * 8/1992 Pappers ..... B60N 2/448 297/284.6 X
5,331,698 A 7/1994 Newkirk et al.
5,369,828 A * 12/1994 Graebe ..... A47C 4/54 297/452.41
5,421,044 A 6/1995 Steensen
5,444,881 A * 8/1995 Landi ..... A61G 5/1043 297/452.41
5,487,197 A * 1/1996 Iskra, Jr. ..... A47C 7/021 297/452.41
5,511,260 A 4/1996 Dinsmoor et al.
(Continued)

FOREIGN PATENT DOCUMENTS

GB 2344514 6/2000

*Primary Examiner* — Rodney B White

(74) *Attorney, Agent, or Firm* — Ben Schroeder Law, PLLC

(57) ABSTRACT

A seating apparatus with adjustable cushioning, comprises a seat base and an inflatable bladder comprising a plurality of air cells. The inflatable bladder is positioned in between at least two polyurethane foam layers, supported on the seat base. The seating apparatus further comprises a pump unit operatively connected to the inflatable bladder via a conduit for inflating or deflating the plurality of air cells for providing adjustable firmness to the seating apparatus.

20 Claims, 3 Drawing Sheets

(56) References Cited

U.S. PATENT DOCUMENTS 5,662,384 A * 9/1997 O'Neill ..... A47C 4/54 297/284.6
5,687,438 A * 11/1997 Biggie ..... A61G 5/1043 297/284.6
5,689,845 A * 11/1997 Sobieralski ..... A61G 7/05769 297/452.41
5,845,352 A * 12/1998 Matsler ..... A47C 7/021 297/452.41
5,868,463 A * 2/1999 MacKenzie ..... A47C 7/021 297/452.41 X
5,893,184 A * 4/1999 Murphy ..... A47C 7/024 297/284.6 X
6,012,772 A 1/2000 Conde
6,036,271 A * 3/2000 Wilkinson ..... A61G 5/1043 297/452.41 X
6,047,421 A 4/2000 Barone
6,209,159 B1 4/2001 Murphy
6,212,719 B1 * 4/2001 Thomas ..... A47C 4/54 297/284.6
6,502,263 B1 * 1/2003 Rowley ..... A47C 7/021 297/452.41 X
6,551,450 B1 * 4/2003 Thomas ..... A61H 9/0078 297/284.6 X
6,625,830 B2 9/2003 Lampel
6,677,026 B1 * 1/2004 Yates ..... A47C 27/085 297/452.41
7,441,294 B2 * 10/2008 Mossbeck ..... A47C 27/082 297/452.41
7,857,387 B2 * 12/2010 Habegger ..... B60N 2/66 297/284.6 X
8,033,600 B2 * 10/2011 Reynolds ..... B60N 2/4415 297/452.41 X
8,157,325 B2 * 4/2012 Machael ..... A47C 7/14 297/284.6 X
8,307,482 B2 11/2012 Gladney et al.
8,733,833 B2 * 5/2014 Dickinson ..... B60N 2/2809 297/452.41 X
8,801,104 B2 * 8/2014 Di Giusto ..... B60N 2/5664 297/284.6
8,910,331 B2 * 12/2014 Wang ..... A47C 7/021 297/452.41
9,021,637 B1 * 5/2015 Whelan ..... A61G 5/1043 297/452.41 X
2002/0027384 A1 * 3/2002 Zur ..... A61G 5/1043 297/452.41
2002/0101099 A1 * 8/2002 Hughes ..... A47C 4/54 297/452.41 X
2003/0030319 A1 * 2/2003 Clapper ..... A47C 4/54 297/452.41
2003/0038517 A1 * 2/2003 Moran ..... B60N 2/4415 297/284.6 X
2003/0205920 A1 * 11/2003 Sprouse, II ..... A47C 4/54 297/452.41 X
2004/0222684 A1 * 11/2004 VanSickle ..... A47C 4/54 297/452.41
2005/0017565 A1 * 1/2005 Sprouse, II ..... A47C 7/14 297/452.41
2005/0151410 A1 * 7/2005 Sprouse, II ..... A47C 7/14 297/452.41
2006/0091716 A1 * 5/2006 Fortune ..... A47C 4/54 297/452.41
2011/0025111 A1 * 2/2011 Wornell ..... A47C 4/54 297/452.41 X
2012/0013165 A1 * 1/2012 Di Giusto ..... B60N 2/5664 297/452.41
2013/0000047 A1 1/2013 McCann et al.
2013/0104311 A1 5/2013 Rensink et al.
2014/0033440 A1 2/2014 Tyree
2014/0182061 A1 7/2014 Zaiss et al.
2014/0319890 A1 * 10/2014 Rivera ..... A47C 7/467 297/452.41 X
2015/0108799 A1 * 4/2015 Jones ..... B60N 2/6027 297/452.41 X

* cited by examiner

SEATING APPARATUS WITH ADJUSTABLE CUSHIONING

FIELD OF THE INVENTION

The present invention generally relates to a seating apparatus, and more particularly relates to an inflatable cushion seat for providing adjustable firmness using an inflatable bladder positioned between polyurethane foam layers.

BACKGROUND OF THE INVENTION

Sitting on a chair or a seating arrangement for longer periods of time can result in discomfort in the back, for example, the lower spine, shoulders and shoulder blades. Seating apparatus including vehicle seats subjected to prolonged and continuous usage demands adequate cushioning support for maintaining proper posture and providing enough comfort.

When a person is seated in a relatively upright position on a seating arrangement, the entire body weight of the person is distributed and supported on a relatively small support surface. Thus, the spring support or cushioning of the seating area must be correspondingly harder, firmer or stiffer in order to provide a comfortable support.

Polyurethane foam is commonly used cushioning material for seating arrangements. The polyurethane foam has a natural characteristic to become softer and softer with prolonged use, especially during usage in any seating application. In many cases, the foam breaks in within weeks and becomes much softer, which may lead to user discomfort due to in adequate cushioning support. Due to the changing characteristics of polyurethane foam, it is difficult to select the firmness of seat cushions in order to make it comfortable and supportive, even after prolonged usage.

Prior art methods of improved cushioning by including air bags positioned within a polyurethane cavity which would permit the ability to control the firmness of the seating area, but this method sacrifices the desirable characteristics of the polyurethane foam by replacing the foam with the air bags which have no desirable elements for achieving comfort on a seating surface.

In addition, seat cushion comprising inflatable element with arrangements such as baffles or channels that permits uniform distribution of force to foam can add to optimal support and comfort. Further, seats with adjustable firmness levels relying on desirable properties of polyurethane foam contribute to durability. In addition, seats provided with cushioning adjustable based on a desired level of user comfort and taste, allows a single seating arrangement to offer customized seating comfort for different individuals. For example, a husband of 200 lbs weight may require seating with increased cushion support than that of his wife of 100 lb weight, the adjustable cushion support allows each of them to adjust cushioning based on their own level of comfort.

U.S. Pat. No. 6,086,151 shows a chair apparatus for resilient support member which produces movement and force based on load applied. U.S. Pat. No. 6,609,753 shows a reclining passenger seat with cushioning properties adjusted based on seating or lying configuration of the seat. US patent publication no. 20140225405 shows an inflatable cushion seat used for sitting comfortably on a hard seat among bleachers. US patent publication no. 20050151410 shows chair with inflatable cellular insert connected to an electric pump device.

Although a number of seating arrangements employing a variety of cushioning options are available, it would be beneficial to provide an improved seating arrangement that includes user adjustable cushioning system that provides desired level of firmness thus resulting in a comfortable support while remaining in a seated position for a long time.

SUMMARY OF THE INVENTION

The present invention relates to a seating apparatus with adjustable cushioning, the seating apparatus comprises a seat base and an inflatable bladder comprising a plurality of air cells, positioned in between at least two polyurethane foam layers, which are supported on the seat base. The apparatus further comprises a pump unit operatively connected to the inflatable bladder via a conduit, wherein the pump unit is configured to inflate or deflate the air cells for providing adjustable firmness to a seating apparatus.

In an embodiment, the inflatable bladder comprising a plurality of air cells, is positioned in between the seat base and one or more polyurethane foam layers. The inflatable bladder is expanded by use of air, liquid or gas, the flow of which can be controlled by a regulatory valve, in order to achieve a desired level of firmness.

DETAILED DESCRIPTION OF THE INVENTION

The following detailed description of the preferred embodiments presents a description of certain specific embodiments to assist in understanding the claims. However, the present invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details.

Figure 1:
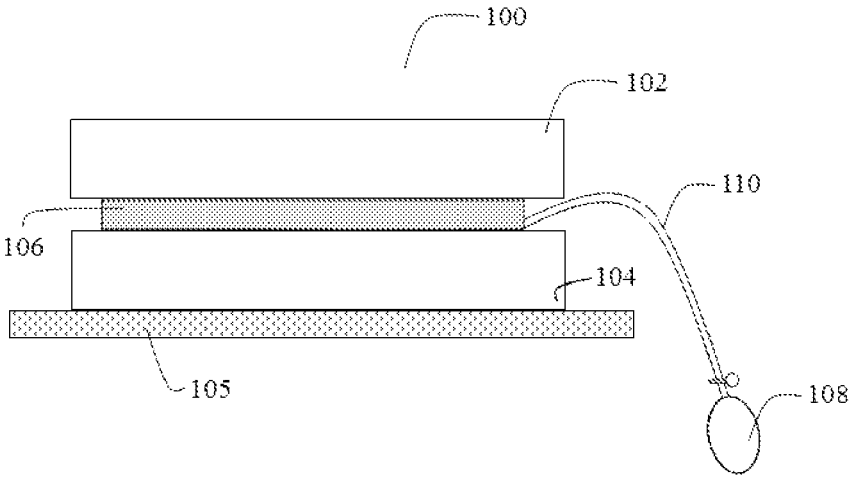
FIG. 1 illustrates an arrangement of layers of the seating apparatus according to an embodiment of the present invention.

Referring to FIG. 1, which shows an arrangement of different layers of the seating apparatus according to an embodiment of the present invention. The seating apparatus 100 comprises a seat base 105 and an inflatable bladder 106 comprising a plurality of air cells, positioned in between two polyurethane foam layers 102, 104, which are supported on the seat base 105. The apparatus 100 further comprises a pump unit 108 operatively connected to the inflatable bladder 106 via a conduit 110, wherein the pump unit 108 is configured to inflate or deflate the air cells for providing adjustable firmness to a seating apparatus 100.

In an exemplary embodiment, a user can adjust the firmness level of the seating apparatus by using the pump unit to inflate or deflate the plurality of air cells distributed in the inflatable bladder. The pump unit 108 comprises a valve, which can be operable to release excess amount of air or pressure from the air cells. Thus, the user can control the amount of air flow to and from the inflatable bladder 106.

Figure 2:
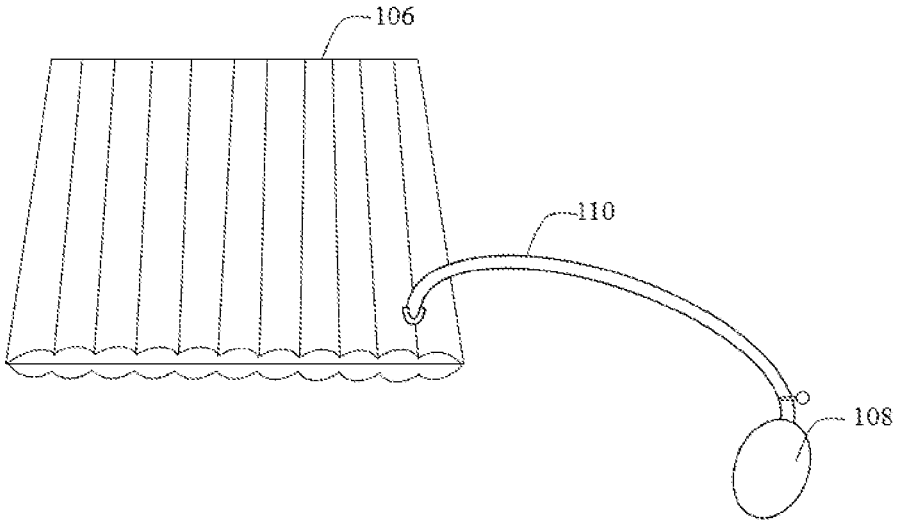
FIG. 2 is a perspective view of the inflatable bladder according to an embodiment of the present invention.

FIG. 2 illustrates a perspective view of the inflatable bladder according to an embodiment of the present invention. The inflatable bladder 106 comprises a plurality of air cells, which are operatively connected to the pump device 108 via the conduit 110 for receiving air supply from the pump device 108 during inflation. In an embodiment, the inflatable bladder 106 comprises a plurality of cushion support rods extending longitudinally, the support rods are made of resilient material and arranged inside a covering.

The pump device 108 further comprises a safety valve for releasing excessive pressure beyond a preset pressure limit. The safety valve aids in preventing the breakage of air cells due to excess pressure. In an embodiment, the pump device 108 contains a regulatory valve for controlling the air supply.

In an embodiment, the air cells are baffled or channeled or tufted, which can be adjusted for providing extra push in desired areas of seating. The pump device 108 may comprise an electric pump, a hand pump or a bulb and valve unit, which can be secured in a compartment or a pouch, fastened using a zipper or Velcro or similar fastening means. The compartment can be strategically placed in such a way that it did not affect the aesthetic quality of the seating apparatus.

The air cells can be manufactured from materials selected from urethane, PVC (polyvinyl chloride), plastic, rubber or resilient fabrics. The air cells can be inflated in a controlled manner utilizing multiple valves and pump units.

Figure 3:
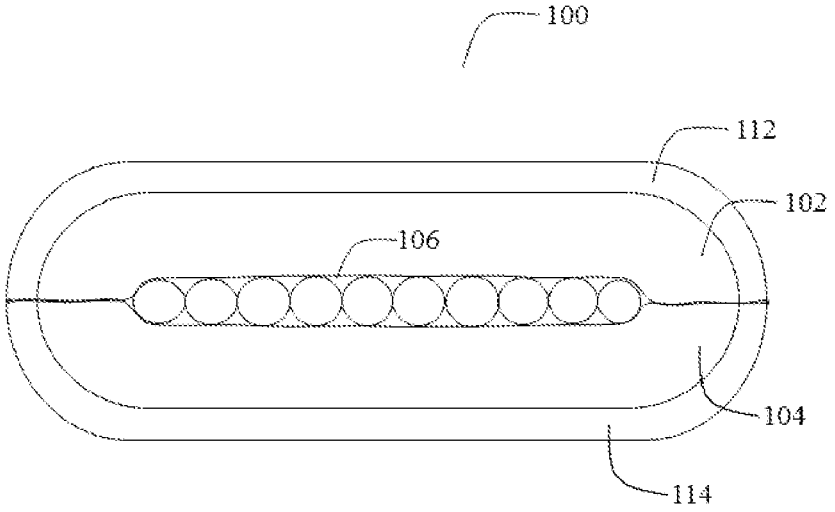
FIG. 3 is a cross sectional view of the seating apparatus in an inflated position according to an embodiment of the present invention.

FIG. 3 is a cross sectional view of the seating apparatus in an inflated position according to an embodiment of the present invention. The seating apparatus 100 comprises inflatable bladder 106 sandwiched between polyurethane foam layers 102 and 104. The inflatable bladder 106 comprise air cells which are baffled in order to control foam compression and even distribution of force to foam during expansion. As the inflatable bladder 106 expands, it compresses the polyurethane on both sides against the cushion casing and as the polyurethane compresses, it becomes firmer and firmer, directly proportional to how much it is compressed. The apparatus 100 may also comprise outer fiber layers 112, 114 covering the polyurethane foam layers 102, 104.

The present invention utilizes all of the polyurethane foam seat construction. In an exemplary embodiment, the foam is split horizontally into two even pieces half the thickness of the original core. The bladder is then positioned between the two halves and glued together encompassing the bladder in the center of the core. A tube or conduit with one end connected to the bladder and exit the polyurethane core at one corner and other end connected to the pump unit, where it can be accessed from an open end of a zippered compartment. This method still utilizes all of the desirable characteristics of the polyurethane foam which has made it the primary choice for comfortable seating.

Once inserted into a finished seat, the bladder may be expanded by use of air, liquid, or gas to compress the polyurethane foam against the fabric cover to provide additional support on the seating surface. The pump device is used to supply the flow of air, liquid, or gas from an exterior source through the conduit inserted into the inflatable bladder. This will cause the bladder to expand which in turn compress the polyurethane foam, yielding a firmer seat. The more the bladder expands, the firmer the seat becomes. For example, the bladder can be selectively deflated in order to achieve a softer seating.

In an embodiment, the inflatable bladder can be positioned between the seat base and one or more polyurethane foam layer, in order to form a firmer sear construction. In this case, the tube can be threaded through a crevice between the seat and the back. The inflatable bladder can also be positioned in a back rest portion of the seating apparatus.

The cushioning properties of seating apparatus can be user controlled or installer controlled or preset at factory during manufacturing. The seating apparatus of the present invention can be used in any upholstered furniture such as chairs, vehicle seats, recliners, sofas and stools.

In addition, seats provided with cushioning adjustable based on desired level of user comfort and taste, allows a single seating arrangement to offer customized seating comfort for different individuals.

The invention claimed is:

1. A seating apparatus with adjustable cushioning, comprising:

a seat base;

an inflatable bladder comprising a plurality of air cells, wherein the inflatable bladder is positioned in between at least two polyurethane foam layers supported on the seat base; and a pump unit operatively connected to the inflatable bladder via a conduit, wherein the pump unit is configured to inflate or deflate the plurality of air cells, thereby compressing or decompressing, respectively, the at least two polyurethane foam layers provide adjustable firmness to the seating apparatus, wherein the pump unit further comprises a safety valve configured to release excessive pressure beyond a preset level.

2. The apparatus of claim 1, wherein the plurality of air cells are channeled, baffled or tufted to control compression of the at least two polyurethane foam layers.

3. The apparatus of claim 1, further comprises at least one fiber layer covering the at least two polyurethane foam layers.

4. The apparatus of claim 1, wherein the inflatable bladder is positioned within a back rest portion of the seating apparatus.

5. The apparatus of claim 1, wherein the pump unit comprises an electric pump, a hand pump or a bulb and valve assembly.

6. A seating apparatus with adjustable cushioning, comprising:

a seat base;

an inflatable bladder comprising a plurality of air cells, wherein the inflatable bladder is positioned in between at least two polyurethane foam layers supported on the seat base; and a pump unit operatively connected to the inflatable bladder via a conduit, wherein the pump unit is configured to inflate or deflate the plurality of air cells, thereby compressing or decompressing, respectively, the at least two polyurethane foam layers provide adjustable firmness to the seating apparatus.

7. The apparatus of claim 6, wherein the plurality of air cells are channeled, baffled or tufted to control compression of the at least two polyurethane foam layers.

8. The apparatus of claim 6, further comprising a regulatory valve that regulates the firmness.

9. The apparatus of claim 8, wherein the pump unit further comprises a safety valve configured to release excessive pressure beyond a preset level.

10. The apparatus of claim 6, wherein the seating apparatus is a cushion.

11. The apparatus of claim 10, wherein the cushion is made by inserting the inflatable bladder between the at least two polyurethane foam layers, the at least two polyurethane foam layers being made by splitting a polyurethane foam piece horizontally into two even pieces, the inflatable bladder and the two even pieces being glued together after the inflatable bladder is inserted.

12. The apparatus of claim 11, further comprising connecting one end of a tube or conduit to the inflatable bladder and the second end to the pump unit.

13. The apparatus of claim 11, wherein the cushion further comprises a cushion.

14. The apparatus of claim 13, wherein the cushion is a chair or a sofa cushion.

15. The apparatus of claim 14, wherein the cushion is a sofa cushion.

16. The apparatus of claim 10, wherein the air cells are baffled or channeled.

17. The apparatus of claim 10, wherein the cushion comprises a cushion casing and the at least two polyurethane foam layers are adjacent to the cushion casing.

18. The apparatus of claim 10, wherein the at least two polyurethane foam layers comprise outer fiber layers covering the at least two polyurethane foam layers.

19. The apparatus of claim 6, wherein the seating apparatus is made by inserting the inflatable bladder between the at least two polyurethane foam layers, the at least two polyurethane foam layers being made by splitting a polyurethane foam piece horizontally into two even pieces, the two even pieces being glued together after the inflatable bladder is inserted.

20. The apparatus of claim 19, further comprising connecting one end of a tube or conduit to the inflatable bladder and the second end to the pump unit.

* * * * *